US005372738A

United States Patent [19]

Tipton

[11] Patent Number: 5,372,738

[45] Date of Patent: Dec. 13, 1994

[54] WATER TOLERANCE FIXES IN FUNCTIONAL FLUIDS AND LUBRICANTS

[75] Inventor: Craig D. Tipton, Perry, Ohio

[73] Assignee: The Lubrizol Corporation, Wickliffe, Ohio

[21] Appl. No.: 97,594

[22] Filed: Jul. 23, 1993

Related U.S. Application Data

[63] Continuation of Ser. No. 493,023, Mar. 12, 1990, abandoned, which is a continuation of Ser. No. 932,439, Nov. 18, 1986, abandoned.

[51] Int. Cl.[5] ..... C09K 5/00

[52] U.S. Cl. ..... 252/77; 252/79; 252/51.5 A; 252/50

[58] Field of Search ..... 252/77, 79, 34, 34.7, 252/51.5 A, 67, 50

[56] References Cited

U.S. PATENT DOCUMENTS

| | | | |
|---|---|---|---|
| 3,219,666 | 11/1965 | Norman et al. | 260/268 |
| 3,324,033 | 6/1967 | Knapp | 252/51.5 |
| 3,714,042 | 1/1973 | Greenough | 252/51.5 A |
| 4,048,080 | 9/1977 | Lee | 252/51.54 |
| 4,225,447 | 9/1980 | Law et al. | 252/34.7 |
| 4,256,595 | 3/1981 | Sung et al. | 252/51.5 |
| 4,329,249 | 5/1982 | Forsberg | 252/34.7 |
| 4,368,133 | 6/1983 | Forsberg | 252/75 |
| 4,401,581 | 8/1983 | Burrows et al. | 252/51.5 |
| 4,435,297 | 3/1984 | Forsberg | 252/34.7 |
| 4,447,348 | 5/1984 | Forsberg | 252/75 |
| 4,448,703 | 5/1984 | Forsberg | 252/75 |
| 4,471,091 | 9/1984 | Hayashi | 525/71 |
| 4,522,736 | 6/1985 | Andress et al. | 252/51.5 |
| 4,579,672 | 4/1986 | Brecker et al. | 252/49.8 |
| 4,929,374 | 5/1990 | De Jong et al. | 252/39 |

FOREIGN PATENT DOCUMENTS

WO87/05046 8/1987 WIPO .

OTHER PUBLICATIONS

Japanese Patent Disclosure (Kokai) No. 56-131695 "Anticorrosive Boiling-Point Lowering Preventative Agent." Filed: Mar. 19, 1980.

*Primary Examiner*—Prince Willis, Jr.
*Assistant Examiner*—James M. Silbermann
*Attorney, Agent, or Firm*—James L. Cordek; Frederick D. Hunter, Sr.; Joseph P. Fischer

[57] ABSTRACT

The present invention is a composition having improved water tolerance properties which is adapted for use as a functional fluid or lubricating composition. The composition is comprised of a major amount of a synthetic or mineral oil of lubricating viscosity and a minor amount of a water tolerance fix compound. The water tolerance fix compound is present in an amount which is effective to improve the water tolerance properties of the composition as a whole which amount is in the range of from about 0.1 parts by weight to about 5 parts by weight per 100 parts by weight of the oil. The water tolerance fix compound is prepared by reacting a nitrogen-containing phosphorus-free carboxylic acid (A) with an alkanol tertiary monoamine (B) to form an ester-salt reaction product. The water tolerance fix compound is present in the oil along with 5 parts by weight of water or less per 100 parts by weight of the oil.

18 Claims, No Drawings

WATER TOLERANCE FIXES IN FUNCTIONAL FLUIDS AND LUBRICANTS

This is a continuation of co-pending application(s) Ser. No. 07/493,023 filed on Mar. 12, 1990 now abandoned which is a continuation of Ser. No. 06/932,439, filed Nov. 18, 1986, now abandoned.

CROSS REFERENCE

This application claims subject matter related to the disclosure of pending U.S. application, Ser. No. 831,021 filed Feb. 19, 1986, of which application I am a co-inventor. The disclosure of the earlier application, Ser. No. 831,021 is incorporated herein by reference and priority to this earlier application is claimed to the extent possibly under 35 USC, Section 120.

FIELD OF THE INVENTION

This invention relates to the field of lubricants containing water tolerance fix compounds. More specifically it relates to functional fluids having contaminant water therein, which water is fixed by incorporating into the fluid a water tolerance fix in the form of a nitrogen-containing phosphorus-free carboxylic acid derivative compound.

BACKGROUND OF THE INVENTION

Water compatibility is a highly significant property of functional fluids and lubricants. The significance of this property is most important under severe conditions such as when the functional fluids and lubricants come into contact with water under extreme pressure and temperature conditions. In the absence of acceptable water tolerance properties, such functional fluids and lubricants will have its lubricating and/or power transmission properties substantially reduced. Accordingly, many manufacturers of equipment requiring the use of functional fluids and lubricants require that such fluids and lubricants contain certain water tolerance properties. For example, manufacturers of agricultural tractor machinery have specific requirements with respect to the tractor fluids used in connection with the machinery; and, such requirements include specific water tolerance properties which the manufacturer believes to be necessary for the equipment to operate successfully under severe conditions.

In addition, the clarity of such functional fluid often impacts greatly on the fluid's marketability. A fluid that is turbid or becomes turbid after a short period of use and exposure to contaminate water, is often unacceptable to consumers regardless of the performance characteristics of the fluid.

U.S. Pat. No. 4,579,672 discloses functional fluids and lubricants having improved water tolerance properties. The compositions are comprised of major amounts of a synthetic or mineral oil of lubricating viscosity with minor amounts of oil soluble alkoxypolyethyleneoxy acid phosphite ester compounds dispersed therein as the water tolerance improving compounds. This patent discusses a number of related patents at columns 1 and 2.

U.S. Pat. Nos. 4,435,297; 4,368,133; 4,329,249; 4,448,703; and 4,447,348 relate to nitrogen-containing phosphorus-free carboxylic acid derivatives. These derivatives are in general made by the reaction of an acylating agent with an alkanol tertiary monoamine. The derivatives described are indicated as being useful in incorporating oil-soluble, water-insoluble functional additives, such as metal salts of acid phosphate and thiophosphate hydrocarbyl esters, into water-based functional fluids such as water-based hydraulic fluids.

U.S. Pat. No. 3,219,666 discloses oil-soluble nitrogen-containing compositions which are indicated as being useful dispersing agents in connection with various lubricants such as crankcase oils, gears, and power transmitting units.

U.S. Pat. No. 4,401,581 discloses lubricating oil dispersants. The dispersants are made by reacting (a) alkenyl succinic anhydride, (b) an alcohol, (c) a hydroxy-substituted amine, (d) polyoxyalkyleneamine, and (e) an alkenyl succinimide.

U.S. Pat. No. 4,225,447 discloses emulsifiable concentrates which are used for water-in-oil fire resistant hydraulic fluids. The concentrate is comprised of a lubricant and a polyalkenylsuccinic acid or anhydride of a salt.

U.S. Pat. No. 3,324,033 discloses oil-soluble lubricating oils having ashless dispersants present therein wherein the ashless dispersants are the reaction product of an alkenyl succinic anhydride and a dethanolamine.

U.S. Pat. No. 4,522,736 discloses compounds which are formed by a reaction involving alkenylsuuccinic anhydrides and aminoalcohols and aromatic secondary amines. The patent also discloses lubricating compositions which contains such reaction products.

U.S. Pat. No. 4,256,595 discloses diesel crankcase lubricant compositions. The compositions include a base oil having therein a 5-amino-triazole-succinic anhydride reaction product. The reaction product is formed by reacting a hydrocarbyl succinic anhydride (in which the hydrocarbyl radical has from 12 to 30 carbon atoms) with 5-amino-triazole.

Japanese Patent Disclosure (Kokai) No. 56-131695 discloses an Anticorrosive Boiling-Point Lowering Preventative Agent containing Boron compounds obtained by dehydrogenation condensation under heating of boric acid with compounds having an amino group and a hydroxyl group.

The present inventor has discovered that improved functional fluids and lubricating compositions can be obtained by combining major amounts of an oil of lubricating viscosity with a minor amount of a water tolerance improving composition. In this respect, the present invention relates to the same general concept which is being carried out in the patents discussed above. However, the compounds which the present inventor utilizes as the water tolerance fix is structurally different from and chemically distinct from the compounds referred to in the above-discussed patents. Although the compounds per se utilized by the present inventor to improve the water tolerance fix properties of the composition are not themselves novel (see U.S. Pat. No. 4,435,297), such compounds as included within oil compositions in the percentage amounts claimed in order to improve water tolerance properties are novel compositions.

U.S. Pat. No. 4,225,447 to Law et al appears to disclose the reaction product of a hydrocarbon substituted succinic anhydride with an N,N-dialkylalkanolamine used as a water tolerance fix in water-in-oil emulsions containing 10–60% water.

The present invention is not an aqueous system or even an oil-in-water emulsion, but rather an oil composition which contains 5% or less of water as a contaminant in the oil composition. Accordingly, in this respect, the present invention is basically different from either the '297 or '447 patents above.

U.S. Pat. No. 4,401,581 to Burrows et al disclosed high molecular weight alkenyl succinic derivatives as effective dispersants in lubricating oils (column 1, lines 8–9). Hydrocarbyl substituents specifically disclosed include polyisobutenyl groups (column 2, lines 25–27). The patent also discloses alkanol amines such as diethanol amine and THAM (see column 2, lines 46–59).

SUMMARY OF THE INVENTION

The present invention is a composition adapted for use as a functional fluid or lubricating composition. The composition is comprised of a major amount of oil of lubricating viscosity which may be a synthetic but is preferably a mineral oil. The water tolerance fix compound within the oil is a nitrogen-containing phosphorous-free carboxylic acid derivative compound. This compound is present in the oil in an amount of from about 0.05 parts by weight to about 5 parts by weight more preferably 0.1 to 0.5 parts by weight based on 100 parts by weight of the oil. Further, the compositions contain less than 5 parts by weight of water per 100 parts by weight of oil as a contaminant.

The primary object of the present invention is provide improved water tolerance properties to various functional fluids and lubricating compositions contaminated with small amounts of water.

An advantage of this invention is that the water fix compound can be included within an oil of lubricating viscosity in relatively small amounts at a relatively low cost.

Another advantage of the invention is that it provides improved filterability to a functional fluid where water contamination occurs by reducing filter clog.

A feature of this invention is that it provides improved water compatibility to functional fluids and lubricating compositions which are subjected to severe operational conditions.

Another feature of the present invention is that the functional fluids and lubricating compositions of the invention with the water fix compound therein meet various agricultural machinery manufactures' specifications with respect to water tolerance properties.

Yet another feature of the present invention is that it provides a composition having a relatively high degree of clarity which can be maintained with contaminant water under severe operational conditions.

Still another feature of the invention is that it acts as a boiling point lowering preventative agent where water contaimination occurs.

These and other objects, advantages and features of the invention will become apparent to those skilled in the art upon reading the present disclosure.

DETAILED DESCRIPTION OF THE INVENTION

The invention is a composition with improved water tolerance properties which is adapted for use as a functional fluid or lubricating composition. The invention also includes a means for improving the clarity of functional fluids and lubricating compositions by including therein small amounts of a water tolerance fix compound. The composition is comprised of a major amount of a synthetic or mineral oil of lubricating viscosity and a minor amount effective to improve the water tolerance properties of the composition of a nitrogen-containing phosphorus-free carboxylic acid derivative compound. This compound is the water fixing compound and is present within the oil in an amount of about 0.05 parts by weight to about 5.0 parts by weight per 100 parts by weight of the oil more preferably 0.1 to about 0.5 parts by weight with about 0.25 parts by wt. being particularly preferred. The water fixing compound can be represented by the general structural formulae (I) and (II)

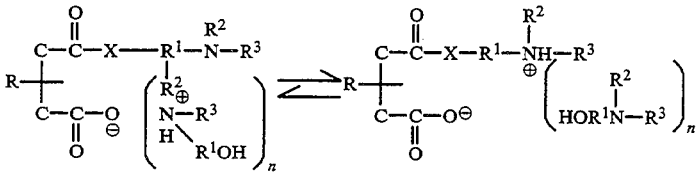

(I) (II)

wherein n is 1 or O ; X is O or NH; R is a hydrocarbyl group which is preferably a polyisobutenyl group containing about 50 to 500 carbon atoms; and $R^1$ is an alkylene containing 1 to 4 carbons and is preferably ethylene. $R^2$ and $R^3$ are each independently alkyl moieties containing 1 to 4 carbons and are each preferably ethyl moieties. A state of equilibrium exists between (I) and II. To insure charge balancing, when n of I is zero a positively charged ion such as hydrogen will attach to the oxygen. The composition contains less than 5 parts by weight of water as a contaminant of the composition per 100 parts by weight of oil.

The nitrogen-containing phosphorus-free carboxylic acid derivatives made by the reaction of (A) at least one carboxylic acid acylating agent with (B) at least one alkanol tertiary amine, said acylating agent having at least one hydrocarbyl-based substituent of about 20 to about 500 carbon atoms and said alkanol amine (B) having one hydroxyl group and a total of up to about 12 carbon atoms.

The individual reactants (A) and (B) and the reaction of (A) with (B) will now be discussed in detail in order to provide a disclosure of a representative number of examples of each. However, it is to be understood that the scope of the present invention is limited only by the appended claims. U.S. Pat. No. 4,435,297 is incorporated herein by reference for purposes of disclosing examples of reactants (A) and (B), the reaction between (A) and (B) and the resulting reaction product.

THE CARBOXYLIC ACID ACYLATING AGENT, (A)

The acylating agents used in making the derivatives of the present invention are well known to those skilled in the art and have been found to be useful as additives for lubricants and fuels and as intermediates for preparing the same. See, for example, the following U.S. Patents which are hereby incorporated by reference for their disclosures relating to the preparation of carboxylic acid acylating agents: 3,219,666; 3,272,746; 3,381,102; 3,254,025; 3,278,550; 3,288,714; 3,271,310; 3,373,111; 3,346,354; 3,272,743; 3,374,174; 3,307,928; and 3,394,179.

Generally, these carboxylic acid acylating agents are prepared by reacting an olefin polymer or chlorinated analog thereof with an unsaturated carboxylic acid or derivative thereof such as acrylic acid, fumaric acid, maleic anhydride and the like. Typically, these acylating agents are polycarboxylic acylating agents such as the succinic acid acylating agents derived from maleic acid, its isomers, anhydride and chloro and bromo derivatives. A dicarboxylic acid in the form of a succinic acid derivative is the preferred acylating agent (A).

These acylating agents have at least one hydrocarbyl-based substituent of about 20 to about 500 carbon atoms. Generally, this substituent has an average of at least about 30, and often at least about 50 carbon atoms. Typically, this substituent has a maximum average of about 300, and often about 200 carbon atoms. As used herein, the term "hydrocarbon-based," hydrocarbon-based substituent" and the like denotes the substituent having a carbon atom directly attached to the remainder of the molecule (i.e., the carboxylic acylating portion) and having predominantly hydrocarbyl character within the context of this invention.

A polyisobutenyl substituent is the preferred substituent on the acylating agent. Accordingly, a polyisobutenyl substituted succinic acid in the preferred reactant (A).

Examples of substituents which might be useful in connection with the present invention include the following:

(1) hydrocarbon substituents, that is, aliphatic (e.g., alkyl or alkenyl), alicyclic (e.g., cycloalkyl, cycloalkenyl) substituents, aromatic, aliphatic and alicyclic-substituted aromatic nuclei and the like as well as cyclic substituents wherein the ring is completed through another portion of the molecule (that is, for example, any two indicated substituents may together form an alicyclic radical);

(2) substituted hydrocarbon substituents, that is, those substituents containing nonhydrocarbon radicals which, in the context of this invention, do not alter the predominantly hydrocarbon substituent; those skilled in the art will be aware of such radicals (e.g., halo (especially chloro and fluoro), hydroxy, alkoxy, mercapto, alkylmercapto, nitro, nitroso, sulfonyl sulfoxy, etc.);

(3) hetero substituents, that is, substituents which will, while having predominantly hydrocarbyl character within the context of this invention, contain other than carbon present in a ring or chain otherwise composed of carbon atoms. Suitable heteroatoms will be apparent to those of skill in the art and include, for example, sulfur, oxygen, nitrogen and such substituents as, e.g., pyridyl, furanyl, thiophenyl, imidazolyl, etc., are exemplary of these hetero substituents.

In general, no more than about three radicals or heteroatoms and preferably no more than one, will be present for each ten carbon atoms in the hydrocarbon-based substituents. Typically, there will be no such radicals or heteroatoms in the hydrocarbon-based substituent and it will, therefore, be purely hydrocarbon.

In general, the hydrocarbon-based substituents of at least about 20 carbon atoms present in the acylating agents used in this invention are free from acetylenic unsaturation; ethylenic unsaturation, when present will generally be such that there is not more than one ethylenic linkage present for every ten carbon-to-carbon bonds in the substituent. The substituents may be completely saturated or contain ethylenic unsaturation.

As noted above, the hydrocarbon-based substituents present in the acylating agents of this invention are derived from olefin polymers or chlorinated analogs thereof. The olefin monomers from which the olefin polymers are derived are polymerizable olefins and monomers characterized by having one or more ethylenic unsaturated group. They can be monoolefinic monomers such as ethylene, propylene, butene-1, isobutene and octene-1 or polyolefinic monomers (usually di-olefinic monomers such as butadiene-1,3 and isoprene). Usually these monomers are terminal olefins, that is, olefins characterized by the presence of the group $$>C{=}CH_2.$$

However, certain internal olefins can also service as monomers (these are sometimes referred to as medial olefins). When such olefin monomers are used, they normally are employed in combination with terminal olefins to produce olefin polymers which are interpolymers. Although the hydrocarbyl-based substituents may also include aromatic groups (especially phenyl groups and lower alkyl and/or lower alkoxy-substituted phenyl group such as para(tertiary butyl)phenyl groups) and alicyclic groups such as would be obtained from polymerizable cyclic olefins or alicyclic-substituted polymerizable cyclic olefins. The olefin polymers are usually free from such groups. Nevertheless, olefin polymers derived from such interpolymers of both 1,3-dienes and styrenes such as butadiene-1,3 and styrene or para(tertiary butyl)styrene are exceptions to this general rule.

Generally the olefin polymers are homo- or interpolymers of terminal hydrocarbyl olefins of about 2 to about 16 carbon atoms. A more typical class of olefin polymers is selected from that group consisting of homo- and interpolymers of terminal olefins to two to six carbon atoms, especially those of two to four carbon atoms.

Specific examples of terminal and medial olefin monomers which can be used to prepare the olefin polymers from which the hydrocarbon-based substituents in the acylating agents used in this invention are ethylene, propylene, butene-1, butene-2, isobutene, pentene-1, hexene-1, heptene-1, octene-1, nonene-1, decene-1, pentene-2, propylene tetramer, diisobutylene, isobutylene trimer, butadiene-1,2, butadiene-1,3, pentadiene-1,2 pentadiene-1,3, isoprene, hexadiene-1,5, 2-chlorobutadiene-1,3, 2-methylheptene-1, 3-cyclohexylbutene-1, 3,3-dimethylpentene-1, styrenedivinylbenzene, vinylacetate allyl alcohol, 1-methylvinylacetate, acryionitrile, ethylacrylate, ethylvinylether and methylvinylketone. Of these, the purely hydrocarbyl monomers are more typical and the terminal olefin monomers are especially typical.

Often the olefin polymers are poly(isobutene)s. As indicated above, polyisobutenyl substituents are preferably in connection with the present invention. These polysiobutenyl polymers may be obtained by polymerization of a $C_4$ refinery stream having a butene content of about 35 to about 75 percent by weight and an isobutene content of about 30 to about 60 percent by weight in the presence of a Lewis acid catalyst such as aluminum chloride or boron trifluoride. These poly(isobutene)s contain predominantly (that is, greater than 80% of the total repeat units) isobutene repeat units of the configuration

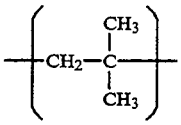

Typically, the hydrocarbyl-based substituent in the carboxylic acid acylating agent as used in the present invention is a hydrocarbyl, alkyl or alkenyl group of about 30, often about 50, to about 500, sometimes about 300, carbon atoms. For convenience herein, such substituents are represented by the indicia "hyd."

As noted above, typical acylating agents (A) used in making the derivatives of this invention are substituted succinic acids or derivatives thereof. In this case, the preferred acylating agent (A) can be represented by the formulae:

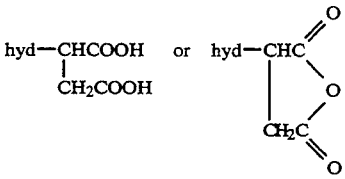

Such succinic acid acylating agents can be made by the reaction of maleic anhydride, maleic acid, or fumaric acid with the afore-described olefin polymer, as is shown in the patents referred to above. Generally, the reaction involves merely heating the two reactants at a temperature of about 150° to about 200°. Mixtures of these polymeric olefins, as well as mixtures of these unsaturated mono-and polycarboxylic acids can also be used.

THE ALKANOL TERTIARY MONOAMINES, (B)

The amines used in making the derivatives of the present invention are tertiary monoamines having one hydroxyl group per molecular and normally up to about 40 carbon atoms. These hydroxyl groups are bonded to an alkyl group which in turn is bonded to the amine portion of the molecule. The two remaining substituents bonded to the tertiary amine nitrogen are hydrocarbyl groups each having one to about 20 carbon atoms. Usually they will also be alkyl groups, but they can be alkenyl groups with one olefinic bond. Typically they are lower alkyl groups of up to seven carbons, though they can also be aryl, aralkyl, alkaryl, cycloalkyl, alkyl cycloalkyl, and cycloalkylalkyl groups. Mixtures of two or more of The amines (B) can also be used.

A typical class of useful amines can be represented by the formula:

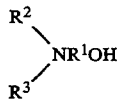

wherein each $R^2$ and $R^3$ are independently an alkyl group of one to about 4 carbon atoms and $R^1$ is a straight or branched chain alkylene group of about 2 to about 4 carbon atoms. The N,N-dialkylalkanol amines within the above formula are particularly preferred, especially these wherein each of $R^2$ and $R^3$ is independently a lower alkyl and $R^1$ is lower alkylene. The $R^2$ and $R^3$ groups can be joined by a carbon-to-carbon bond.

The present inventor has found that the most preferred alkanol amine (B) is N,N-diethyl ethanol amine and that N,N-dimethyl-2-hydroxybutyl amine is useful. The present inventor has found that reactant (B) such as N,N-diethyl ethanol amine can be reacted with a preferred reactant (A) to provide a water tolerance fix compound which has unusually good heat stability and provides excellent water tolerance properties under extreme conditions.

Now that a disclosure has been given with respect to both reactants (A) and reactants (B), a general description will be given of the reaction of (A) and (B). Although an extremely large number of reaction products are possible, the present invention is only concerned with such reaction products wherein an internal salt is formed. The formation of such internal salts will be described in further detail below.

THE REACTION OF THE ACYLATING AGENT (A) WITH THE ALKANOL AMINE (B) TO FORM THE NITROGEN-CONTAINING DERIVATIVE

The reaction of the acylating agent with the alkanol amine can be carried out at a temperature ranging from about 30° C. to the decomposition temperature of one or more of the reaction components and/or products. Typically, it is carried out at a temperature in the range of about 50° C. to about 150° C. The reaction is preferably carried out under ester-forming conditions and the product thus formed is an ester/salt. As concerns the present invention, this salt is either an internal salt involving residues of a molecule of acrylating agent and of amine, wherein one of the carboxyl groups becomes ionically bound to a nitrogen atom within the same group or an external salt wherein the ionic salt group is formed with a nitrogen atom which is not part of the same molecule. Structures showing the internal and external salts are shown below respectively as formulae (I) and (II).

Mixtures of acylating agents and/or mixtures of alkanol amines can be used. Generally, the equivalent ratio of acylating agent to alkanol amine formed is in the range of about 0.5 to about 3 equivalents of amine per equivalent of carboxylic acylating agent. An equivalent of carboxylic acylating agent can be determined by dividing the molecular weight of the acylating agent by the number of carboxyl functions. This can usually be determined from the structural formula of the acylating agent or empirically through well-known titration procedures. Thus a succinic anhydride has an equivalent weight of half its molecular weight. An equivalent of alkanol amine is equal to its molecular weight. Preferred equivalent ratios of acylating agent (A) to amine (B) is in the range of about 1:1 to about 1:2.5.

Usually the agent (A) and amine (B) are reacted at a temperature below about 100° C., often in the absence of additional solvent/diluents.

Supplemental reagents

While the afore-described acylating agent (A) and amines (B) are the only necessary acylating agent and amines present in the reaction producing the derivatives of this invention, it is sometimes the case that supplemental carboxylic acylating agents (C) and/or alkanol amine (D) are present. It is, of course, essential that the (A) agents and (B) amines be present in significant amounts; this means at least 50 (mole) % of the total acylating agent (i.e., (A) plus (C)) and at least 50(mole) % of the total amine (i.e., (B) plus (D)) are the essential acylating agent (A) and amine (B), respectively.

Typical supplemental acylating agents (C) include fatty acids of 10 to 18 carbon atoms such as oleic, stearic, linoleic acids and the well-known commercial fatty acid mixtures such as coco acids, tallow acids, tall oil acids, and the like. Low molecular weight alkyl and alkenyl succinic acid acylating agents such as tetrapropenyl succinic anhydride can also be included in the supplemental acylating agent class.

Typical supplemental alkanol amines (D) can contain up to about 26 carbon atoms and include primary, secondary and tertiary alkanol amines (e.g., ethanol amine, di-(2-propanol)-amine, N,N-di(2-hydroxy ethyl)ethyl amine, 2-, 3- and 4-hydroxy butanol amines and their monomethyl homolog, N(2-hydroxyethyl)aniline and triethanol amine. The supplemental alkanol amines (D) usually will be one or more amines of the formula $$R_1R_2N-R_3-OH$$

wherein $R_1$ and $R_2$ are each independently selected from the group consisting of hydrogen, alkyl, alkenyl, hydroxyl alkyl, and hydroxyl alkenyl and $R_3$ is straight or branched chain alkylene. Usually $R_1$ and $R_2$ will each independently be hydrogen or lower alkyl and $R_3$ will be lower alkylene. Ethanol amine is especially preferred. Of course, when one or more supplemental alkanol amines (D) are present, they will be different than the alkanol tertiary monoamines (A). In other words, it is a proviso that (D) is exclusive of (A).

As noted above, the supplemental acylating agents (C) and/or amines (D) can, respectively, constitute no more than up to about 50(mole) % of the total acylating agent or amine present in the reaction mixture. Sometimes they are not present at all and the acylating agent (A) and alkanol amine (B) are the only acylating agent and amine present.

The following are specific examples of the preparation of nitrogen-containing, phosphorus-free carboxylic acid derivatives. In these examples all parts and percentages are by weight unless expressly stated to the contrary and all temperatures are in degrees Celsius, as is the case throughout the specification and appended claims.

EXAMPLE A

To a charge of 2,240 parts of a poly(isobutene)-substituted succinic anhydride (having a molecular weight of 1,120) heated in a resin kettle with stirring to about 90° slowly add over a two-hour period 468 parts of diethyl ethanol amine. Continue heating for an additional hour at about 90°. The desired reaction product is a viscous, clear, brown-tinted liquid at room temperature.

The product of Example A can be added to a mineral oil of lubricating viscosity in an amount of about 0.5 to about 3 parts by weight of reaction product per 100 parts by weight of oil, which oil contains about 5 parts by weight or less of water as a contaminant. Additional compounds can and generally are added to improve various performance properties of the desired functional fluid or lubricating composition.

EXAMPLE 1

Include the water fixing agent of Example A into the functional fluid system of a tractor which has in the fluid 1 part by weight of water based of the weight of tractor fluid. The water fixing agent of Example A should be added in an amount of 0.1 to 0.5 parts by weight per 100 parts by weight of tractor fluid.

EXAMPLE B

To a charge of 6,720 parts of the succinic anhydride described in Example 1, heated to 90° with stirring, slowly add over 1.5 hours 702 parts of diethyl ethanol amine. Heat this intermediate mixture for an additional 0.5 hour at 90° . Then slowly add 366 parts of monoethanol amine. Hold the mixture at 90° for a final 0.5 hour and cool to provide a clear brown, viscous liquid product.

The water tolerance fix of Example B can be used to form tractor fluids of the invention by adding about 0.1 to about 5.0 parts by weight of the reaction product to about 100 parts by weight of a tractor fluid which contains a total of about 5.0 parts by weight or less of water.

EXAMPLE 2

Add the water tolerance fix of Example B to the hydraulic fluid of a hydraulic system of a machine whose hydraulic system is contaiminated about 0.5 to about 1.0 with parts by weight of water. The water fix of Example B should be added in an amount of about 0.1 to about 3 parts by weight per 100 parts by weight of hydraulic fluid.

EXAMPLE 3

Add 0.15 parts by weight of the compound of Example A and 0.15 parts by weight of the compound of Example B to a tractor fluid, (amounts are in terms of per 100 parts by weight of tractor fluid) where the tractor system includes 2 parts by weight of water as a contaminant.

EXAMPLE 4

A tractor fluid formulation may be prepared by adding about 3 percent by weight of an overbased calcium sulfonate salt complex; 3 percent by weight of dithiophosphate; 1 percent by weight of a borated epoxide; 2 percent by weight of styrene/maleic anhydride improver and 0.02 percent by weight of a silicon anti-foam agent dissolved in hydrocarbon oil. This formulation could be included in the hydraulic system of a tractor and thereby subjected to adverse influences including contamination with about 2 to 4% by weight of water. In order to fix the contaminate water add about 0.1 to 5 parts by weight of the compound of Example A.

EXAMPLE 5

Prepare a functional fluid formulation by adding 2 by weight of an overbased calcium sulfonate salt complex; 2 percent by weight of a zinc dithiophosphate treated with triphenylphosphite; 0.5 percent by weight of a borated epoxide; 2 percent by weight of a styrene/-maleic anhydride VI improver; and 0.02 percent by weight of a silicon anti-foaming agent dissolved in hydrocarbon oil. Treat this formulation with 0.25% of the compound of Example A and add to a hydraulic system thus providing 2% by weight of contaminant water.

EXAMPLE 6

A functional fluid could be prepared by adding 1.5 percent by weight of an overbased calcium sulfonate salt complex; and 1.5 percent by weight of a zinc dithiophosphate treated with an olefin; 0.5 percent by weight of a berated epoxide; 2 percent by weight of a styrene/-maleic anhydride VI improver; and 0.02 percent by weight of a silicon anti-foaming agent dissolved in hydrocarbon oil. Add the formulation to a system containing contaminate water in an amount of about 2% by weight along with about 0.1 to 3.0 parts by weight of the compound of Example B.

In examples 4, 5 and 6 above, some variation is possible with respect to what each of the actual components will be, e.g. an overbased calcium sulfonate salt complex might be a calcium sulfonate complex which has been overbased with a calcium compound and then treated with polyisobutylene succinic acid or anhydride having a molecular weight in the range of from about 700 to about 5,000. The zinc dithiophosphate component might be a mixture of zinc salts of bis(2-ethylhexyl)dithiophosphate and 2-ethylhexyl carboxylic acid treated with triphenylphosphite. This salt is preferably combined with a stoichiometric excess of zinc, i.e., the salt is preferably over-zinced including about 1.2 to about stoichiometric equivalents of zinc. The berated epoxide may be a product obtained as a result of the reaction of boric acid with 1,2-epoxide containing about 16 carbon atoms. The formulations of Examples 4, 5 and 6 may include other components depending upon the desired end use. The actual specific chemical compound used for each of the essential components, their amounts, as well as other additional active chemicals will be chosen by these skilled in the art depending upon the specific requirements of the functional fluid being produced. Variations in the amounts and the actual specific type of chemical component will be deducible by those of ordinary skill in the art upon consideration of their needs and a reading of the present description.

EXAMPLE 7

An additive concentrate package may be prepared by combining together the following: 48.00% by wt of the reaction product of isobutyl, amyl alcohol dithiophosphoric acid, methyl acrylate and propylene oxide; 33.6% by wt of a $C_9$ mono-and-di para alkylated diphenylamine; 20.52% by wt of the reaction product of propylene tetramer succinic acid and propylene oxide; 0.40% by wt of tolytriazol; 0.56% by wt poly oxyalkylene demulsifier; and 14.92% by wt diluent oil. The additive concentrate can then be combined with a mineral or synthetic oil in an amount of about 0.5 to about 2 parts by wt conc. per 100 parts by wt oil. The resulting treated oil can then be added to the hydraulic system of a machine and thus subjected to adverse conditions including contamination with about 0.5 to about 1% by wt of water. The water contaminant can be fixed by the addition of about 0.1 to 5 parts by wt of the compound of Example A.

EXAMPLE 8

The concentrate of EXAMPLE 7 may be prepared and added to a mineral oil in an amount of about 1.25 parts of concentrate per 100 parts of oil, the oil containing about 0.25 parts by weight of the compound of EXAMPLE B. The hydraulic fluid is added to a hydraulic system and subjected to adverse conditions including about 1.0% by wt. contaminant water.

The present invention has been disclosed and described herein and what is believed to be preferred embodiments thereof. However, variations may occur to those skilled in the art upon reading the present disclosure. Accordingly, it is understood that the present invention disclosed herein is intended to cover such variations as fall within the scope of the appended claims.

What is claimed is:

1. A composition adapted for use as a functional fluid or lubricating composition consisting of:

a major amount of an oil of lubricating viscosity; and an amount in the range of from about 0.1 to about 5 parts by weight based on 100 parts by weight of the oil, the amount being effective to improve the water tolerance properties of the composition of a nitrogen-containing, phosphorus-free ester/salt reaction product obtained by reacting reactant (A) with reactant (B), under ester-forming conditions at a reaction temperature below about 100° C. and at an equivalent weight ratio of (A):(B) of about 1:1–2.5 wherein (A) is selected from the group consisting of:

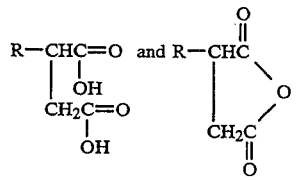

(A)

wherein R is hydrocarbyl containing a sufficient number of 4 carbon atoms to provide for oil solubility of the reaction product; and (B) is selected from the group of compounds represented by:

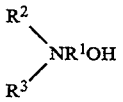

(B)

wherein $R^1$ is an alkylene moiety containing 1 to carbon atoms and $R^2$ and $R^3$ are each an alkyl moiety containing 1 to 4 carbon atoms, the composition containing less than 5 parts by weight of water per 100 parts by weight of oil.

2. The composition as claimed in claim 1 wherein the reaction product is present in an amount of about 0.to about 1.0 parts by weight based on the weight of the oil, and the water is present in the oil in an amount in the range of from about 0.1 parts by weight to about 4.0 parts by weight per 100 parts by weight of oil.

3. The composition as claimed in claim 1 wherein R is a polyisobutenyl moiety containing from about 30 to about 500 carbon atoms.

4. The composition as claimed in claim 1 wherein $R^1$ is ethylene and $R^2$ and $R^3$ are ethyl.

5. The composition as claimed in claim 4 wherein the reaction product is present in an amount in the range of from about 0.2 to about 0.5 parts by weight based on t100 parts by weight of the oil.

6. A composition adapted for use as a functional fluid or lubricating composition consisting of:

a major amount of an oil of lubricating viscosity; and an amount in the range of from about 0.1 to about 3 parts by weight based on 100 parts by weight of the oil, the amount being effective to improve the water tolerance properties of the composition, of a nitrogen-containing, phosphorus-free ester/salt represented by a formula selected from the group of formulae (I) and (II)

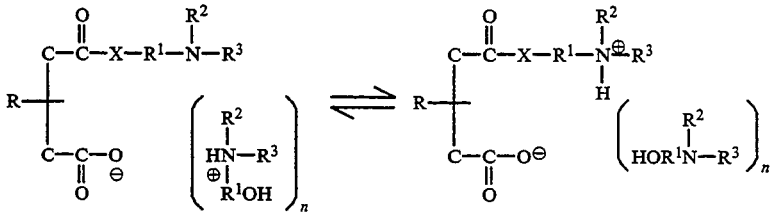

(I) (II)

wherein n is 0 or 1; X is O or NH; R is hydrocarbyl; $R^1$ is an alkylene moiety containing 1 to 4 carbon atoms; and $R^2$ and $R^3$ are independently alkyl moieties containing 1 to 4 carbon atoms and the composition contains less than 5 parts by weight of water per 100 parts by weight of oil.

7. The composition as claimed in claim 6 wherein R is a polyisobutenyl moiety containing about 50 to about 400 carbons.

8. The composition as claimed in claim 7 wherein $R^1$ is an ethylene moiety and $R^2$ and $R^3$ are each an ethyl moiety.

9. The composition as claimed in claim 7 wherein the ester/salt is present in an amount of about 0.1 to about 0.5 parts by weight per 100 parts by weight of the oil.

10. A method of improving the water tolerance properties of a functional fluid comprised of an oil of lubricating viscosity having therein 0.1 to 4 parts by weight of water, consisting of the steps of:

adding a water tolerance fix in an amount of 0.1 to about 5 parts by weight based on 100 parts by weight of the oil, the water tolerance fix being a nitrogen-containing, phosphorus-free ester/salt reaction product obtained by reacting reactant (A) with reactant (B), under ester forming conditions at a reaction temperature below about 100° C. and at an equivalent weight ratio of (A):(B) of about 1:1–2.5 wherein:

(A) is selected from the group consisting of:

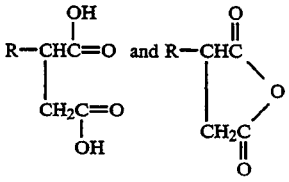

(B)

wherein R is hydrocarbyl containing a sufficient number of carbon atoms to provide for oil solubility of the reaction product; and (B) is selected from the group of compounds represented by:

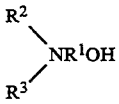

(B)

wherein $R^1$ is an alkylene moiety containing 1 to 4 carbon atoms and $R^2$ and $R^3$ are each an alkyl moiety containing 1 to 4 carbon atoms; and dispersing the water tolerance fix in the oil so as to fix the water and thereby improve the water tolerance properties of the fluid.

11. The method as claimed in claim 10 wherein the water tolerance fix is added in an amount of about 0.1 to about 1 parts by weight based on 100 parts by weight of the oil.

12. The method as claimed in claim 11, wherein R is a polyisobutenyl moiety containing from about 30 to about 500 carbon atoms.

13. The method as claimed in claim 12 wherein $R^1$ is ethylene and $R^2$ and $R^3$ are ethyl.

14. The method as claimed in claim 13 wherein the water tolerance fix is added in an amount in the range of from about 0.2 to about 0.5 parts by weight based on 100 parts by weight of the oil.

15. A method of improving the water tolerance properties of a functional fluid comprised of an oil of lubricating viscosity having therein 0.1 to 4 parts by weight of water, consisting of the steps of:

adding a water tolerance fix in an amount of 0.1 to about 5 parts by weight based on 100 parts by weight of the oil, the water tolerance fix being in the form of a nitrogen-containing, phosphorus-free ester/salt represented by a formula selected from the group of formulae (I) and (II)

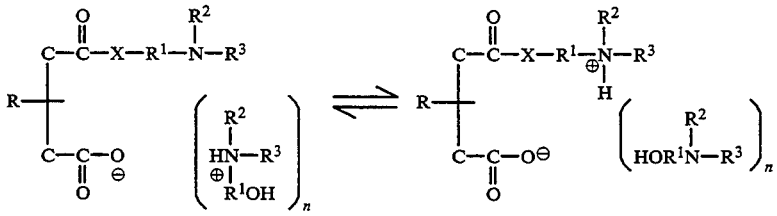

(I) (II)

wherein n is 0 or 1; X is O or NH; R is hydrocarbyl; $R^1$ is an alkylene moiety containing 1 to 4 carbon atoms; and $R^2$ and $R^3$ are independently alkyl moieties containing 1 to 4 carbon atoms; and allowing the water tolerance fix to disperse in the oil so as to fix the water and thereby improve the water tolerance properties of the fluid.

16. The method as claimed in claim 15, wherein R is a polyisobutenyl moiety containing about 50 to about 400 carbon atoms.

17. The method as claimed in claim 16, wherein $R^1$ is ethylene and $R^2$ and $R^3$ are each an ethyl moiety.

18. The method as claimed in claim 17 wherein the water tolerance fix is added in an amount of about 0.1 to about 0.5 parts by weight per 100 parts by weight of the oil.

* * * * *